United States Patent [19]

Abkowitz et al.

[11] Patent Number: 4,731,115

[45] Date of Patent: Mar. 15, 1988

[54] TITANIUM CARBIDE/TITANIUM ALLOY COMPOSITE AND PROCESS FOR POWDER METAL CLADDING

[75] Inventors: Stanley Abkowitz, Lexington; Harold L. Heussi, Essex; Harold P. Ludwig, Woburn, all of Mass.

[73] Assignee: Dynamet Technology Inc., Burlington, Mass.

[21] Appl. No.: 704,263

[22] Filed: Feb. 22, 1985

[51] Int. Cl.[4] ..... C22C 29/02

[52] U.S. Cl. ..... 75/236; 419/17; 419/27; 419/28; 419/29; 419/30; 419/32; 419/38; 419/68; 427/404; 427/405; 427/419.7; 428/565; 428/627; 428/660

[58] Field of Search ..... 420/420, 565, 627, 660; 75/236; 148/127, 11.5 R; 419/38, 47, 17, 68; 428/614; 427/404, 405, 419.7

[56] References Cited

U.S. PATENT DOCUMENTS

| | | | |
|---|---|---|---|
| 3,510,276 | 5/1970 | Dawihl et al. | 75/236 |
| 3,737,290 | 6/1973 | Frehn | 75/236 |
| 4,432,794 | 2/1984 | Holleck | 419/17 |
| 4,469,757 | 9/1984 | Ghosh et al. | 148/11.5 R |
| 4,561,272 | 12/1985 | Goldstein | 428/660 |

*Primary Examiner*—Stephen J. Lechert, Jr.
*Attorney, Agent, or Firm*—Finnegan, Henderson, Farabow, Garrett & Dunner

[57] ABSTRACT

A microcomposite material having a matrix of a titanium-base alloy, the material further including about 10–80% by weight TiC substantially uniformly dispersed in the matrix. Several methods of cladding a macrocomposite structure including pressing quantities of a matrix material and a microcomposite material composed of the matrix material and a compatible stiffener material into layers to form a multi-layered compact and sintering the multi-layered compact to form an integral metallurgical bond between the layers of the compact with diffusion but essentially no composition gradient between the layers. A multi-layered macrocomposite article composed of an alloy layer of a matrix material and a layer of a microcomposite material composed of the matrix material and a compatible stiffener material bonded together at the interface region between the layers, the interface region being essentially free of a composition gradient.

52 Claims, 4 Drawing Figures

TITANIUM CARBIDE/TITANIUM ALLOY COMPOSITE AND PROCESS FOR POWDER METAL CLADDING

FIELD OF INVENTION

The present invention relates to powder metallurgy and, more particularly, to a macrocomposite material, process for powder metal cladding, and a multi-layered macrocomposite article.

BACKGROUND OF THE INVENTION

Powder metallurgy (P/M) involves the processing of metal powders. One of the major advantages of P/M is the ability to shape powders directly into a final component form. Using P/M techniques, high quality, complex parts may be economically fabricated. There are also other reasons for using P/M techniques. Properties and microstructures may be obtained using P/M that cannot be obtained by alternative metal working techniques. Among these microstructures are included oxide dispersion strengthened alloys, cermets, cemented carbides, and other composite materials.

P/M may also be used in metal joining operations such as cladding. U.S. Pat. No. 2,490,163 to Davies discloses a method of producing alloy-clad titanium. A composite structure of titanium and titanium alloy is formed by hot pressing together layers of titanium and titanium alloy powders. According to Davies, the powders are hot pressed at temperatures and times sufficient to allow diffusion between the layers to form a graduated bond between the titanium and titanium alloy powders. The composition of the graduated bond progresses from pure titanium to the alloy composition in a uniform gradient so that no definite line of demarcation exists between the layer of titanium and the titanium alloy. The resulting diffusion dilutes the compositions of the layers comprising the composite structure which deleteriously effects the properties of the composite structure. In addition, the gradient is difficult to control and to reproduce consistently. Consequently, to avoid the resulting dilution in composition of the layers, it would be desirable to form a composite structure in a manner which avoids the formation of a graduated bond in the region between the layers of the structure.

Furthermore, an open porosity structure (i.e. either a powder, compact or sintered article) cannot be further densified by hot isostatic pressing because the high pressure gas will penetrate through the open interconnected pores. Conventionally, the porous structure is sealed from the high pressure gas by a fabricated steel can, a glass or ceramic fused coating, or a melted metal coating. These sealant methods frequently falter by virtue of contamination or high fabrication cost. The disclosed "P/M canning" technique maintains compatibility between the initially open porosity structure and the clad throughout processing. Porous compacts are clad with a compatible material by cold isosatic pressing to enclose the multi-layered compact, then sintered to produce a closed porosity clad or "P/M can"; thus permitting the final step of hot isostatic pressing to densify the encapsulated porous compact.

Accordingly, it is an object of the invention to provide a method of cladding a macrocomposite structure that avoids the formation of a graduated bond in the region between the layers of a macrocomposite structure.

It is a further objective of the invention to provide an improved microcomposite material which may be utilized in forming a macrocomposite structure.

A still further object of the invention is to provide a multi-layered macrocomposite article with improved properties wherein the individual layers of the article maintain their integrity.

Additional objects and advantages will be set forth in part in the description which follows, and in part, will be obvious from the description, or may be learned by practice of the invention.

SUMMARY OF THE INVENTION

To achieve the foregoing objects and in accordance with the purpose of the invention, as embodied and broadly described herein, the microcomposite material of the present invention has a matrix comprised of a titanium-base alloy, the material further including about 1 to 80% by weight TiC substantially uniformly dispersed in the matrix.

Preferably, the microcomposite material includes 20, 35, or 50% by weight TiC substantially uniformly dispersed in a Ti-6Al-4V matrix.

The present invention also includes a method of cladding a macrocomposite structure comprising selecting a matrix material and a compatible stiffener material, blending the matrix material and stiffener material to form a microcomposite material blending, selecting a material from the group consisting of the matrix material and the microcomposite material, pressing a quantity of the selected material into a layer, pressing a quantity of the remaining material onto the layer of the selected material to form a multi-layered compact, and sintering the multi-layered compact to form an integral metallurgical bond between the layers of the compact with diffusion but essentially no composition gradient between the layers.

Preferably, the matrix material is Ti-6Al-4V and the compatible stiffener material is TiC. The multi-layered compact may be further densified by, prior to the step of sintering, including the step of encasing the multi-layered compact with a thin layer of a compatible material capable of sintering to a closed porosity, and subsequent to the step of sintering, including the step of hot isostatically pressing the multi-layered compact.

The present invention further includes a multi-layered macrocomposite article comprising a layer of a matrix material and a layer of a microcomposite material comprised of the matrix material and a compatible stiffener material bonded together at the interface region between the layers, the interface region being essentially free of a composition gradient.

DESCRIPTION OF THE PREFERRED EMBODIMENTS

Reference will now be made in detail to the present preferred embodiments of the invention, examples of which are illustrated in the accompanying drawings.

In accordance with the invention, the microcomposite material of the present invention has a matrix comprised of a titanium-base alloy, the material further including about 1 to 80% by weight TiC substantially uniformly dispersed in the matrix.

In accordance with the invention, the microcomposite material is formed by uniformly dispersing TiC in a titanium-base alloy matrix. Both the TiC and the titanium-base alloy are in powder form and P/M techniques may be used to blend the powders to insure substantially uniform dispersion of the TiC in the titanium-base alloy matrix. The amount of TiC added to the matrix ranges from about 1 to 80% by weight. The titanium-base alloy matrix is preferably Ti-6Al-4V, however, other titanium-base alloys including, but not limited to, Ti-6Al-6V-2Sn, Ti-6Al-2Sn-4Zr-2Mo, Ti-10V-2Fe-3Al, and Ti-5Al-2.5Sn may be used as the matrix material. After blending, the microcomposite material is pressed into a compact of an adequate green strength and sintered using P/M techniques. Preferably, the microcomposite material is cold isostatically pressed and the compact sintered at temperatures ranging from 2200°-2250° F.

The range of temperatures at which the compact is sintered is low enough so that essentially none of the TiC reacts with the titanium-base alloy matrix to diffuse therein.

TiC has a high modulus and is an extremely hard, wear-resistant material. Conversely, the titanium-base alloy matrix material has a low modulus and a relatively low wear resistance. The resulting microcomposite material exhibits higher hardness, higher modulus, and improved wear resistance. The microcomposite material maintains the excellent corrosion resistance of the titanium-base alloy matrix material. The microcomposite material is less ductile than the titanium-base alloy matrix material, but not nearly as brittle as TiC. The weight of the microcomposite material is not significantly more than that of the titanium-base alloy matrix material.

In a preferred embodiment, the microcomposite material includes about 20% by weight TiC substantially uniformly dispersed in a Ti-6Al-4V matrix. In another preferred embodiment, the microcomposite material includes about 35% by weight TiC substantially uniformly dispersed in a Ti-6Al-4V matrix. In a further preferred embodiment, the microcomposite material includes about 50% by weight TiC substantially uniformly dispersed in a Ti-6Al-4V matrix. These materials are designated by the assignee with the trademarks "CermeTi 20," "CermeTi 35," and "CermeTi 50" respectively.

Figure 1:
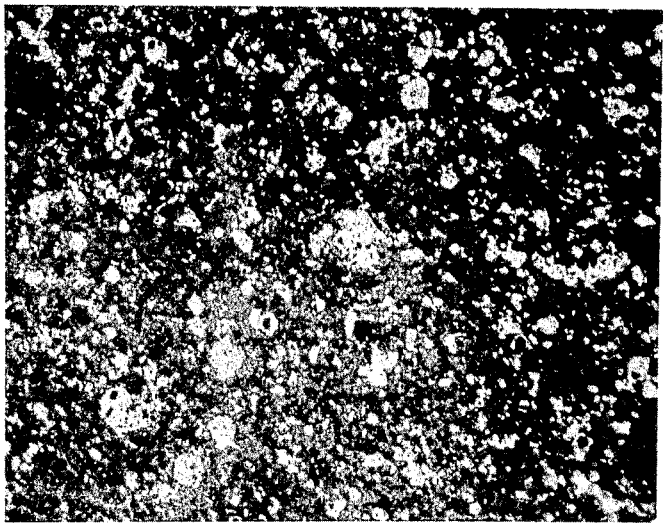
FIG. 1 is a photomicrograph of the microstructure of the microcomposite material having 20% by weight TiC substantially uniformly dispersed in a Ti-6Al-4V matrix.

FIG. 1 shows the microstructure of the microcomposite material having about 20% TiC substantially uniformly dispersed in a Ti-6Al-4V matrix.

The present invention also includes a method of cladding a microcomposite structure. In accordance with the invention, the method of cladding a microcomposite structure comprises selecting a matrix material and a compatible stiffener material, blending the matrix material and stiffener material to form a microcomposite material blend, selecting a material from the group consisting of the matrix material and the microcomposite material, pressing a quantity of the selected material into a layer, pressing a quantity of the remaining material onto the layer of the selected material to form a multi-layered compact, and sintering the multi-layered compact to form an integral metallurgical bond between the layers of the compact with diffusion but essentially no composition gradient between the layers.

As used herein, on a microcomposite level, the term "compatible" is defined as indicating a material capable of being sintered in a surrounding or adjacent matrix material wtth essentially no diffusion and no composition gradient between the material and the matrix material of a microcomposite. On a macrocomposite level, the term "compatible" is defined as indicating a material capable of being sintered in a surrounding or adjacent material *with* diffusion *but no* composition gradient between the alloy layer and the matrix material of the microcomposite layer in a macrocomposite structure. In the latter case, the diffusion results from the fact that the materials are alloys of the same composition.

In accordance with the invention, the matrix material and the compatible stiffener material are blended together using P/M techniques to form a microcomposite material. The microcomposite material described in detail above may be used in the method. Next, a material from the group consisting of the matrix material and the microcomposite material is selected for pressing. In comparison with the matrix material, the microcomposite material generally exhibits higher hardness, higher modulus, improved wear resistance, but lower ductility. In some applications, it may be desirable to have the harder microcomposite material on the outside of the macrocomposite structure. In other applications, it may be desirable to have the more ductile matrix material on the outside of the macrocomposite structure. Consequently, the material selected first for pressing will depend on the intended application of the macrocomposite structure.

If the microcomposite material is selected for pressing first, the method includes pressing a quantity of the microcomposite material into a microcomposite layer and then pressing a quantity of the matrix material into an alloy layer on the layer of microcomposite material to form a multi-layered compact. If the matrix material is selected for pressing first, the method includes pressing a quantity of the matrix material into an alloy layer and then pressing a quantity of the microcomposite material into a microcomposite layer on the alloy layer to form a multi-layered compact.

The layer of the selected material and the layer of the remaining material may be pressed using P/M techniques. Preferably, the layer of the selected material and the layer of the remaining material are cold isostatically pressed.

After the selected material is pressed, a quantity of the remaining material is disposed on the pressed layer of the selected material and pressed to form a multi-layered compact. Because the microcomposite material includes substantial amounts of the matrix material, the pressing step forming the multi-layered compact essentially presses two similar powders together, resulting in the formation of a mechanical bond between the layers of the multi-layered compact. Thus, the step of pressing a quantity of the remaining material onto the layer of the selected material includes the step of forming a mechanical bond between the layers of the multi-layered compact.

If desired, instead of repeatedly loading and pressing alternate layers, the macrocomposite structure may be formed by simultaneously pressing alternate layers of the microcomposite material and an alloy of the same composition as the matrix material of the microcomposite material. In this situation, the method includes alternately predisposing quantities of the matrix material and the microcomposite material, and simultaneously pressing the quantities of the matrix material and the microcomposite material into layers to form a multi-layered compact having at least an alloy layer and at least a microcomposite layer.

When the alloy and microcomposite layers are simultaneously pressed using P/M techniques, the simultaneous pressing step is at about 60,000 psi. When the alloy and microcomposite layers are alternately and repeatedly loaded and pressed, the multiple pressings occur between 20,000 to 60,000 psi.

The method of cladding a macrocomposite structure may be used to form a variety of shapes including plates, tubes, and complex shapes such as T-sections. To form a tube, the step of pressing a layer of the selected material further includes the steps of predisposing the selected material around a mandrel and pressing a layer of the selected material around the mandrel. The step of pressing a layer of the remaining material onto the selected material also includes the steps of predisposing the remaining material around the layer of the selected material pressed around the mandrel and pressing a layer of the remaining material onto the layer of the selected material pressed around the mandrel to form a tubular multi-layered compact.

Figure 3:
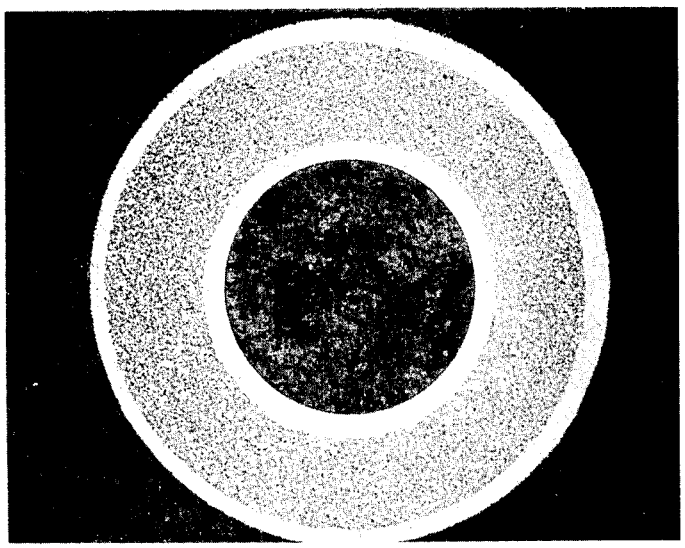
FIG. 3 is a photomicrograph of a cross section of a tubular composite structure formed in accordance with the method of the present invention.

FIG. 3 shows a cross section of a tubular multi-layered macrocomposite structure formed in accordance with the method of the present invention. In FIG. 3, the tubular composite structure is comprised of three layers. The inner and outer layers are matrix material and the middle layer is microcomposite material.

In accordance with the invention, the multi-layered compact is then sintered using P/M techniques at suitable temperatures. When the matrix material is Ti-6Al-4V and the compatible stiffener material is TiC, the multi-layered compact is sintered at about 2200°–2250° F. In this temperature range, there is essentially no diffusion of the TiC into the adjacent and surrounding Ti-6Al-4V matrix material. The diffusion which does take place is the diffusion of the Ti-6Al-4V matrix material with the same Ti-6Al-4V matrix material which effectively leaves the specific compositions unaltered. Thus, the individual layers of the multi-layered compact maintain their compositional integrity during sintering. The diffusion of matrix material only results in the formation of an integral metallurgical bond between the alloy layer of matrix material and the microcomposite layer. Accordingly, the formation of a graduated bond between the layers is avoided.

In some applications, it may be desirable to further densify the sintered multi-layered compact. This may be accomplished by, prior to the step of sintering, including the step of encasing the multi-layered compact with a thin layer of a compatible material capable of sintering to a closed porosity, and subsequent to the step of sintering, including the step of hot isostatically pressing the multi-layered compact.

After sintering, the microcomposite material normally will have an open porosity. Conventionally, in order to hot isostatically press the sintered multi-layered compact to high density it would be necessary to utilize a canning technique to seal the outside layer or layers of the porous microcomposite material. To avoid the canning step, the multi-layered compact is, prior to the step of sintering, encased with a thin layer of compatible material capable of sintering to a closed porosity. Thus, after sintering, the entire sintered multi-layered compact is surrounded by a thin layer of a compatible material of closed porosity. In this manner, the sintered multi-layered compact may be hot isostatically pressed without the use of expensive canning techniques.

The thin layer of compatible material capable of sintering to a closed porosity may be Ti or other titanium based alloys including, but not limited to, Ti-6Al-4V, Ti-6Al-6V-2Sn, Ti-6Al-2Sn-4Zr-2Mo, Ti-10V-2Fe-3Al and Ti-5Al-2.5Sn. Preferably, the multi-layered compact is encased with a thin layer of the particular matrix material used in forming the multi-layered compact.

The multi-layered compact may be hot isostatically pressed using P/M techniques at suitable pressures, temperatures and times. When the matrix material is Ti-6Al-4V and the compatible stiffener material is TiC, the hot isostatic pressing step is performed at 15,000–40,000 psi at 1650°–2600° F. for 1–4 hours. Because TiC requires higher temperatures for hot isostatic pressing, the temperature of the hot isostatic pressing step is a function of the amount of TiC present in the microcomposite material. As the amount of TiC present is increased, the sintered multi-layered compact may be hot isostatically pressed at higher temperatures within the previously described range.

In addition to hot isostatic pressing, the sintered multi-layered compact may also be further densified by other processes. The multi-layered compact may be presintered to form a multi-layered preform. The multi-layered preform may be further fabricated and densified by forging, rolling, or extrusion. Finish forging, finish rolling, and finish extruding are particularly useful in the fabrication of complex shapes.

The present invention also includes a multi-layered macrocomposite article comprising a layer of a matrix material and a layer of a microcomposite material comprised of the matrix material and a compatible stiffener material bonded together at the interface region between the layers, the interface region being essentially free of a composition gradient.

The method of cladding a macrocomposite structure described in detail above may be used to form the multi-layered article. For example, a quantity of matrix material is pressed into an alloy layer. Next, a quantity of composite material is pressed into a microcomposite layer on the alloy layer to form a multi-layered compact. The multi-layered compact is then encased with a thin layer of matrix material and sintered. After sintering, the sintered multi-layered compact is hot isostatically pressed.

Figure 2:
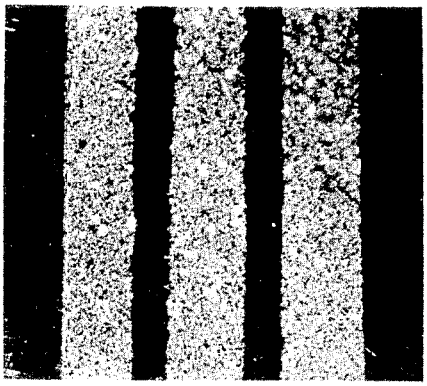
FIG. 2 is a photomicrograph of a cross section of a seven-ply plate encased in matrix material formed in accordance with the method of the present invention.

The multi-layered article may be formed with as many layers as desired. Further, the thickness of the layers may be adjusted as desired to suit the intended application of the multi-layered article. For example, FIG. 2 shows a plate having seven layers. The seven ply plate comprises four alloy layers of Ti-6Al-4V matrix material and three microcomposite layers of 35% TiC-65% Ti-6Al-4V microcomposite material. As shown in FIG. 2, the plate is encased with a thin layer of Ti-6Al-4V alloy material which is compatible with the matrix material of the microcomposite material.

Figure 4:
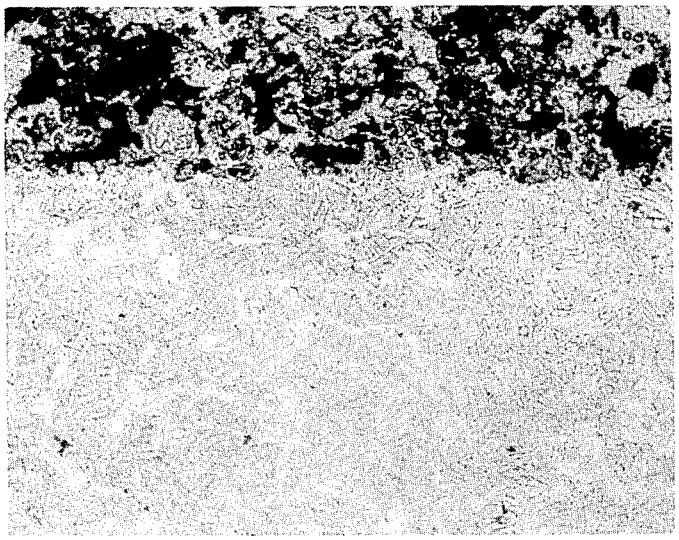
FIG. 4 is a photomicrograph of the interface region between layers of microcomposite material and matrix material in a multi-layered macrocomposite article.

The alloy and microcomposite layers comprising the multi-layered article are bonded together at the interface region between the layers, the interface region being essentially free of a composition gradient. FIG. 4 shows the interface region between the alloy and microcomposite layers. In FIG. 4, the upper portion of the photomicrograph is a microcomposite layer and the lower portion is an alloy layer matrix material. As can be seen in FIG. 4, a definite line of demarcation exists between the alloy layer of matrix material and the microcomposite layer and thus the interface region is essentially free of a composition gradient.

It will be apparent to those skilled in the art that various modifications and variations can be made in the microcomposite material and method of cladding a macrocomposite structure of the present invention and in the formation of the multi-layered macrocomposite article without departing from the scope or spirit of the invention.

What is claimed is:

1. A microcomposite material having a matrix consisting essentially of a titanium-base alloy, said material further including about 1 to 80% by weight TiC substantially uniformly dispersed in the matrix, said microcomposite material being formed by sintering at a temperature disposed to preclude diffusion of the TiC into the matrix.

2. the microcomposite material of claim 1, wherein said TiC is dispersed in said matrix by dispersing powdered TiC into powdered metal disposed to form said matrix.

3. The microcomposite material of claim 2, wherein the matrix is Ti-6Al-4V.

4. The microcomposite material of claim 2, wherein the amount of TiC present is about 20% by weight.

5. The microcomposite material of claim 2, wherein the amount of TiC present is about 35% by weight.

6. The microcomposite material of claim 2, wherein the amount of TiC present is about 50% by weight.

7. A method of cladding a macrocomposite structure comprising:

selecting a matrix material and a compatible stiffener material;

blending the matrix and stiffener material to form a microcomposite material blend;

pressing a quantity of the matrix material to form an alloy layer;

pressing a quantity of the microcomposite material to form a microcomposite layer on the alloy layer to form a multi-layered compact; and sintering the multi-layered compact to form an integral metallurgical bond between the layers of the compact with diffusion but essentially no composition gradient between the microcomposite layer and the alloy layer.

8. The method of claim 7, wherein the layer of matrix material and the layer of composite material are cold isostatically pressed.

9. The method of claim 7, wherein the step of pressing a quantity of composite material onto the layer of matrix material includes the step of forming a mechanical bond between the layers of the multi-layered compact.

10. The method of claim 7, also including prior to the step of sintering, the step of encasing the multi-layered compact with a thin layer of a compatible material capable of sintering to a closed porosity; and subsequent to the step of sintering, the step of hot isostatically pressing the multi-layered compact.

11. The method of claim 7, wherein the step of pressing a quantity of the matrix material further includes the steps of:

predisposing a quantity of the matrix material around a mandrel; and pressing the matrix material into a layer around the mandrel.

12. The method of claim 11, wherein the step of pressing a quantity of the composite material onto the matrix material also includes the steps of:

predisposing the composite material around the layer of matrix material pressed around the mandrel; and pressing the composite material into a layer around the layer of matrix material pressed around the mandrel to form a tubular multi-layered compact.

13. The method of claim 7, wherein the matrix material is Ti-6Al-4V.

14. The method of claim 7, wherein the compatible stiffener material is TiC.

15. The method of claim 7, wherein the composite material is about 80% by weight Ti-6Al-4V and about 20% by weight TiC.

16. The method of claim 7, wherein the composite material is about 65% by weight Ti-6Al-4V and about 35% by weight TiC.

17. A method of cladding a macrocomposite structure comprising:

selecting a matrix material and a compatible stiffener material;

blending the matrix and stiffener material to form a microcomposite material blend;

pressing a quantity of the microcomposite material to form a microcomposite layer;

pressing a quantity of the matrix material to form an alloy layer on the microcomposite layer to form a multi-layered compact; and sintering the multi-layered compact to form an integral metallurgical bond between the layers of the compact with diffusion but essentially no composition gradient between the microcomposite layer and the alloy layer.

18. The method of claim 17, wherein the layer of matrix material and the layer of composite material are cold isostatically pressed.

19. The method of claim 17, wherein the step of pressing a quantity of matrix material onto the layer of composite material includes the step of forming a mechanical bond between the layers of the multi-layered compact.

20. The method of claim 17, also including prior to the step of sintering, the step of encasing the multi-layered compact with a thin layer of a compatible material capable of sintering to a closed porosity; and subsequent to the step of sintering, the step of hot isostatically pressing the multi-layered compact.

21. The method of claim 17, wherein the step of pressing a quantity of the composite material further includes the steps of:

predisposing a quantity of the composite material around a mandrel; and pressing the composite material into a layer around the mandrel.

22. The method of claim 21, wherein the step of pressing a quantity of the matrix material onto the composite material also includes the steps of:

predisposing the matrix material around the layer of composite material pressed around the mandrel; and cold isostatically pressing the matrix material into a layer around the layer of composite material pressed around the mandrel to form a tubular multi-layered compact.

23. The method of claim 17, wherein the matrix material is Ti-6Al-4V.

24. The method of claim 17, wherein the compatible stiffener material is TiC.

25. The method of claim 17, wherein the composite material is about 80% by weight Ti-6Al-4V and about 20% by weight TiC.

26. The method of claim 17, wherein the composite material is about 65% by weight Ti-6Al-4V and about 35% by weight TiC.

27. The method of claim 17, wherein the multi-layered compact is sintered at about 2200°-2250° F.

28. A method of cladding a macrocomposite structure comprising:

selecting a matrix material and a compatible stiffener material;

blending the matrix material and stiffener material to form a microcomposite material blend;

selecting a material from the group consisting of the matrix material and the microcomposite material;

pressing a quantity of the selected material to form a layer;

pressing a quantity of the remaining material onto the layer of the selected material to form a multi-layered compact; and sintering the multi-layered compact to form an integral metallurgical bond between the layers of the compact with diffusion but essentially no composition gradient between the layers.

29. The method of claim 28, wherein the layer of the selected material and the layer of the remaining material are cold isostatically pressed.

30. The method of claim 28, wherein the step of pressing a quantity of the remaining material onto the layer of the selected material includes the step of forming a mechanical bond between the layers of the multi-layered compact.

31. The method of claim 28, also including prior to the step of sintering, the step of encasing the multi-layered compact with a thin layer of a compatible material capable of sintering to a closed porosity; and subsequent to the step of sintering, the step of hot isostatically pressing the multi-layered compact.

32. The method of claim 28, wherein the step of pressing a layer of the selected material further includes the steps of:

predisposing the selected material around a mandrel; and pressing a layer of the selected material around the mandrel.

33. The method of claim 32, wherein the step of pressing a layer of the remaining material onto the selected material also includes the steps of:

predisposing the remaining material around the layer of the selected material pressed around the mandrel; and pressing a layer of the remaining material onto the layer of the selected material pressed around the mandrel to form a tubular multi-layered compact.

34. The method of claim 28, wherein the matrix material is Ti-6Al-4V.

35. The method of claim 28, wherein the compatible stiffener material is TiC.

36. The method of claim 28, wherein the composite material is about 80% by weight Ti-6Al-4V and about 20% by weight TiC.

37. The method of claim 28, wherein the composite material is about 65% by weight Ti-6Al-4V and about 35% by weight TiC.

38. The method of claim 28, wherein the multi-layered compact is sintered at about 2200°-2250° F.

39. A method of cladding a macrocomposite structure comprising:

selecting a matrix material and a compatible stiffener material;

blending the matrix material and stiffener material to form a microcomposite material blend;

alternately predisposing quantities of the matrix material and the microcomposite material;

simultaneously pressing the quantities of the matrix material and the microcomposite material into layers to form a multi-layered compact having at least an alloy layer and at least a microcomposite layer; and sintering the multi-layered compact to form an integral metallurgical bond between the layers of the compact with diffusion but no composition gradient between the microcomposite layer and the alloy layer.

40. The method of claim 39 wherein the simultaneous pressing step is at about 60,000 psi.

41. A multi-layered macrocomposite article comprising an alloy layer of a matrix formed from a powdered metal and a layer of a microcomposite material comprised of the matrix material and a compatible stiffener material bonded together at the interface region between the layers, the interface region being essentially free of a composition gradient.

42. The multi-layered article of claim 41, wherein the layers are encased by a thin layer of a compatible material.

43. The multi-layered article of claim 41, wherein the thin layer of compatible material is comprised of one of the group consisting of Ti, Ti-6Al-4V, Ti-6Al-6V-2Sn, Ti-6Al-2Sn-4Zr-2Mo, Ti-10V-2Fe-3Al, Ti-5Al-2.5Sn.

44. The multi-layered article of claim 41, wherein the article is a plate.

45. The multi-layered article of claim 41, wherein the article is a tube.

46. The multi-layered article of claim 41, wherein the matrix material is Ti-6Al-4V.

47. The multi-layered article of claim 41, wherein the microcomposite stiffener material is TiC.

48. The multi-layered article of claim 41, wherein the microcomposite material is about 80% by weight Ti-6Al-4V and about 20% by weight TiC.

49. The multi-layered article of claim 41, wherein the microcomposite material is about 65% by weight- Ti--6Al-4V and about 35% by weight TiC.

50. A multi-layered composite article comprised of a metal alloy layer formed from powder and a metal matrix composite; said metal matrix composite being comprised of said metal alloy of said metal alloy layer strengthened by a uniform dispersion of a powdered stiffener material compatible with said metal alloy; said metal alloy layer being bonded to said metal matrix composite at an interface region, said region being essentially free of a composition gradient.

51. The article of claim 50 wherein said stiffener material consists essentially of TiC.

52. The article of claim 50 wherein said metal alloy consists essentially of a titanium-base alloy.

* * * * *